US011131282B2

(12) United States Patent
Tamai

(10) Patent No.: US 11,131,282 B2
(45) Date of Patent: Sep. 28, 2021

(54) FUEL INJECTION PUMP

(71) Applicant: DENSO CORPORATION, Kariya (JP)

(72) Inventor: Naoya Tamai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/800,006

(22) Filed: Feb. 25, 2020

(65) Prior Publication Data

US 2020/0277922 A1 Sep. 3, 2020

(30) Foreign Application Priority Data

Mar. 1, 2019 (JP) ..... JP2019-037755

(51) Int. Cl.

| | |
|---|---|
| ***F02M 45/06*** | (2006.01) |
| ***F02M 59/44*** | (2006.01) |
| ***F02M 59/10*** | (2006.01) |
| ***F04B 9/04*** | (2006.01) |
| *F04B 1/0413* | (2020.01) |
| *F04B 1/0417* | (2020.01) |

(52) U.S. Cl.

CPC ..... *F02M 45/063* (2013.01); *F02M 59/102* (2013.01); *F02M 59/44* (2013.01); *F04B 9/042* (2013.01); *F04B 1/0413* (2013.01); *F04B 1/0417* (2013.01)

(58) Field of Classification Search

CPC ..... F02M 45/063

See application file for complete search history.

(56) References Cited

U.S. PATENT DOCUMENTS

| | | | | |
|---|---|---|---|---|
| 1,480,256 A * | 1/1924 | Gates | F04B 43/082 | 417/474 |
| 2,813,523 A * | 11/1957 | Bischoff | F02M 41/126 | 417/289 |
| 2,871,796 A * | 2/1959 | Dreisin | F02M 45/06 | 417/494 |
| 3,433,172 A * | 3/1969 | Sola | F02M 59/102 | 92/116 |
| 3,439,655 A * | 4/1969 | Eyzat | F02M 45/063 | 123/300 |
| 3,690,768 A * | 9/1972 | Nagasawa | F02M 45/063 | 123/300 |

(Continued)

FOREIGN PATENT DOCUMENTS

| | | |
|---|---|---|
| DE | 10 2009 028 392 | 2/2011 |
| DE | 10 2010 041 422 | 3/2012 |

*Primary Examiner* — Kevin R Steckbauer

(74) *Attorney, Agent, or Firm* — Nixon & Vanderhye PC

(57) ABSTRACT

A fuel injection pump pressurizes and injects fuel. A cam rotates about a rotational axis of the cam. A housing includes a cam chamber that houses the cam and a sliding chamber communicated to the cam chamber. A roller rotates while being in contact with a surface of the cam. A shoe reciprocates in the sliding chamber by rotation of the cam and is in contact with and slides on a surface of the roller. A plunger reciprocates with the shoe. A cylinder houses the plunger and includes a pump chamber to pressurize and feed the fuel by reciprocation of the plunger. A deformed section is a groove or a protrusion which extends in a direction of a rotational axis of the cam, on a part of a surface of the cam, and has a shape different from a cam profile of the cam.

13 Claims, 10 Drawing Sheets

(56) References Cited

U.S. PATENT DOCUMENTS 3,722,490 A * 3/1973 Araya ..... F02M 45/063 123/179.17
3,738,180 A * 6/1973 Sola ..... F02M 59/102 74/53
3,827,419 A * 8/1974 Isomura ..... F02M 45/063 123/300
4,064,856 A * 12/1977 Augustin ..... F02D 1/10 123/369
4,441,654 A * 4/1984 Peters ..... F02M 57/023 239/89
4,505,245 A * 3/1985 Lintott ..... F02M 41/042 123/448
4,535,641 A * 8/1985 Kriz ..... F02M 59/102 123/90.25
4,754,737 A * 7/1988 Ishida ..... F02D 1/12 123/357
4,803,889 A * 2/1989 Harris ..... F02M 59/102 74/53
5,076,769 A * 12/1991 Shao ..... F04B 11/0066 417/534
5,081,885 A * 1/1992 Shaffer ..... B66D 3/00 74/125
5,277,156 A * 1/1994 Osuka ..... F02D 41/123 123/198 DB
5,281,104 A * 1/1994 Bublitz ..... F04B 1/0413 417/271
5,364,242 A * 11/1994 Olsen ..... F04B 9/042 417/474
5,580,223 A * 12/1996 Bueser ..... F02M 41/1416 417/219
5,592,915 A * 1/1997 Ishiwata ..... F02M 45/06 123/300
5,647,326 A * 7/1997 Kato ..... F02M 59/265 123/500
5,911,207 A * 6/1999 Ohishi ..... F02M 45/02 123/299
6,009,858 A * 1/2000 Teerman ..... F02M 55/001 123/506
6,032,641 A * 3/2000 Aketa ..... F02M 45/063 123/299
6,230,689 B1 * 5/2001 Tengroth ..... F02M 59/366 123/508
6,394,762 B1 * 5/2002 Collingborn ..... F04B 1/02 123/516
6,668,800 B2 * 12/2003 Ricco ..... F02D 41/38 123/446
6,672,290 B2 * 1/2004 Ricco ..... F02M 55/02 123/506
6,763,808 B2 * 7/2004 Ryuzaki ..... F02M 59/08 123/446
7,011,012 B2 * 3/2006 Hartsleben ..... F02M 59/06 92/153
7,024,980 B2 * 4/2006 Uryu ..... F02M 59/102 92/129
7,267,106 B2 * 9/2007 Adachi ..... F02D 41/3836 123/436
7,311,087 B2 * 12/2007 Shaull ..... F02M 59/102 123/509
7,428,894 B2 * 9/2008 Kikutani ..... F02D 41/3845 123/458
7,513,756 B2 * 4/2009 Aoki ..... F02M 47/027 417/470
7,726,284 B2 * 6/2010 Hori ..... F02M 63/0225 123/501
7,775,193 B2 * 8/2010 Merz ..... F02M 59/102 123/495
7,792,629 B2 * 9/2010 Sczomak ..... F04B 9/042 701/103
7,927,082 B2 * 4/2011 Haudenschild ..... F04B 9/107 417/539
7,938,632 B2 * 5/2011 Smith ..... F04B 9/042 417/415
8,887,694 B2 * 11/2014 Hada ..... F02M 39/02 123/508
8,915,232 B2 * 12/2014 Tamai ..... F04B 1/0426 123/508
8,967,037 B2 * 3/2015 Jones ..... F01L 1/14 92/129
9,091,255 B2 * 7/2015 Yoshimura ..... F02M 37/06
9,127,656 B2 * 9/2015 Rampen ..... F01B 1/0648
9,506,399 B2 * 11/2016 Hayashi ..... F16H 61/423
9,879,570 B2 * 1/2018 Todo ..... F01L 1/143
9,957,846 B2 * 5/2018 Miyazawa ..... F01L 1/14
10,001,098 B2 * 6/2018 Ando ..... F04B 1/0408
10,054,090 B2 * 8/2018 Schmidbauer ..... F02M 59/44
10,072,645 B2 * 9/2018 Inatani ..... F04B 19/22
10,174,733 B2 * 1/2019 Thornthwaite ..... F04B 39/0284
10,227,976 B2 * 3/2019 Inatani ..... F02M 59/442
10,280,884 B2 * 5/2019 Meier ..... F02M 59/102
10,436,164 B2 * 10/2019 Wang ..... F02M 59/102
10,851,738 B2 * 12/2020 Gukelberger ..... F02M 26/04
10,907,623 B2 * 2/2021 Bleisch ..... F04B 1/053
2002/0092503 A1 * 7/2002 Ricco ..... F02M 55/025 123/446
2002/0096145 A1 * 7/2002 Ricco ..... F02M 59/366 123/446
2003/0029424 A1 * 2/2003 Ryuzaki ..... F02M 59/08 123/456
2004/0091377 A1 * 5/2004 Uryu ..... F02M 59/102 417/470
2004/0109775 A1 * 6/2004 Hartsleben ..... F04B 1/0404 417/439
2005/0103311 A1 * 5/2005 Adachi ..... F02M 63/0225 123/456
2006/0110273 A1 * 5/2006 Shaull ..... F04B 1/0439 417/470
2006/0157032 A1 * 7/2006 Hori ..... F02M 63/0225 123/458
2007/0128056 A1 * 6/2007 Haudenschild ..... F04B 9/02 417/415
2007/0154326 A1 * 7/2007 Merz ..... F04B 1/053 417/205
2007/0169619 A1 * 7/2007 Smith ..... F04B 17/03 91/493
2008/0115770 A1 * 5/2008 Merchant ..... F04B 17/05 123/508
2009/0025686 A1 * 1/2009 Kato ..... F02M 63/0225 123/456
2009/0092511 A1 * 4/2009 Jiang ..... F04B 9/042 417/539
2009/0164093 A1 * 6/2009 Sczomak ..... F02M 39/02 701/103
2010/0037864 A1 * 2/2010 Dutt ..... F16H 25/14 123/508
2012/0145131 A1 * 6/2012 Yoshimura ..... F04B 1/0448 123/495
2012/0260765 A1 * 10/2012 Fox ..... F03C 1/04 74/567
2012/0260795 A1 * 10/2012 Rampen ..... F04B 1/053 91/218
2012/0312158 A1 * 12/2012 Rampen ..... F16H 53/025 92/140
2013/0133621 A1 * 5/2013 Jones ..... F02M 59/102 123/456
2013/0149171 A1 * 6/2013 Caldwell ..... F04B 1/00 417/53
2013/0206112 A1 * 8/2013 Tamai ..... F02M 59/102 123/508
2014/0190454 A1 * 7/2014 Hada ..... F02F 7/006 123/495
2014/0216203 A1 * 8/2014 Takamizawa ..... F04B 1/0439 74/569
2014/0311463 A1 * 10/2014 Hayashi ..... F02B 39/04 123/561
2015/0211454 A1 * 7/2015 Tanabe ..... F04B 53/16 417/364
2016/0222934 A1 * 8/2016 Oki ..... F02M 59/102
2016/0222960 A1 * 8/2016 Inatani ..... F04B 53/143

(56) References Cited

U.S. PATENT DOCUMENTS

| | | | | |
|---|---|---|---|---|
| 2016/0245248 | A1* | 8/2016 | Ando | F04B 1/0439 |
| 2016/0290177 | A1* | 10/2016 | Miyazawa | F01L 1/143 |
| 2017/0051637 | A1* | 2/2017 | Todo | F01L 1/146 |
| 2017/0082094 | A1* | 3/2017 | Inatani | F04B 17/05 |
| 2017/0328322 | A1* | 11/2017 | Meier | F04B 1/0408 |
| 2018/0128226 | A1* | 5/2018 | Thornthwaite | F04B 39/0284 |
| 2018/0163710 | A1* | 6/2018 | Bleisch | F04B 9/042 |
| 2018/0171950 | A1* | 6/2018 | Schmidbauer | F02M 59/44 |
| 2018/0266374 | A1* | 9/2018 | Wang | F04B 9/042 |
| 2019/0383242 | A1* | 12/2019 | Gukelberger | F02M 26/04 |
| 2020/0018296 | A1* | 1/2020 | Zhang | F04B 1/0426 |
| 2021/0033043 | A1* | 2/2021 | Ishikawa | F02D 41/3863 |

* cited by examiner

FUEL INJECTION PUMP

CROSS REFERENCE TO RELATED APPLICATION

The present application claims the benefit of priority from Japanese Patent Application No. 2019-037755 filed on Mar. 1, 2019. The entire disclosure of the above application is incorporated herein by reference.

TECHNICAL FIELD

The present disclosure relates to a fuel injection pump.

BACKGROUND

A known fuel injection pump pressurizes fuel, and the fuel is injected and supplied to an internal combustion engine or the like.

SUMMARY

According to an aspect of the present disclosure, a fuel injection pump includes a cam, a housing, a roller, a shoe, a plunger, a cylinder, and a deformed section. The cam includes a cam ridge. The housing includes a cam chamber which houses the cam and a sliding chamber communicated to the cam chamber. Lubricating oil is supplied to the housing. The shoe is in contact with and slides on a surface of the roller on a side opposite to the cam. The cylinder houses the plunger and includes a pump chamber to pressurize and feed the fuel by a reciprocation of the plunger. The deformed section is a groove or a protrusion which extends in a direction of a rotational axis of the cam, formed on a part of a surface of the cam, and has a shape different from a cam profile.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
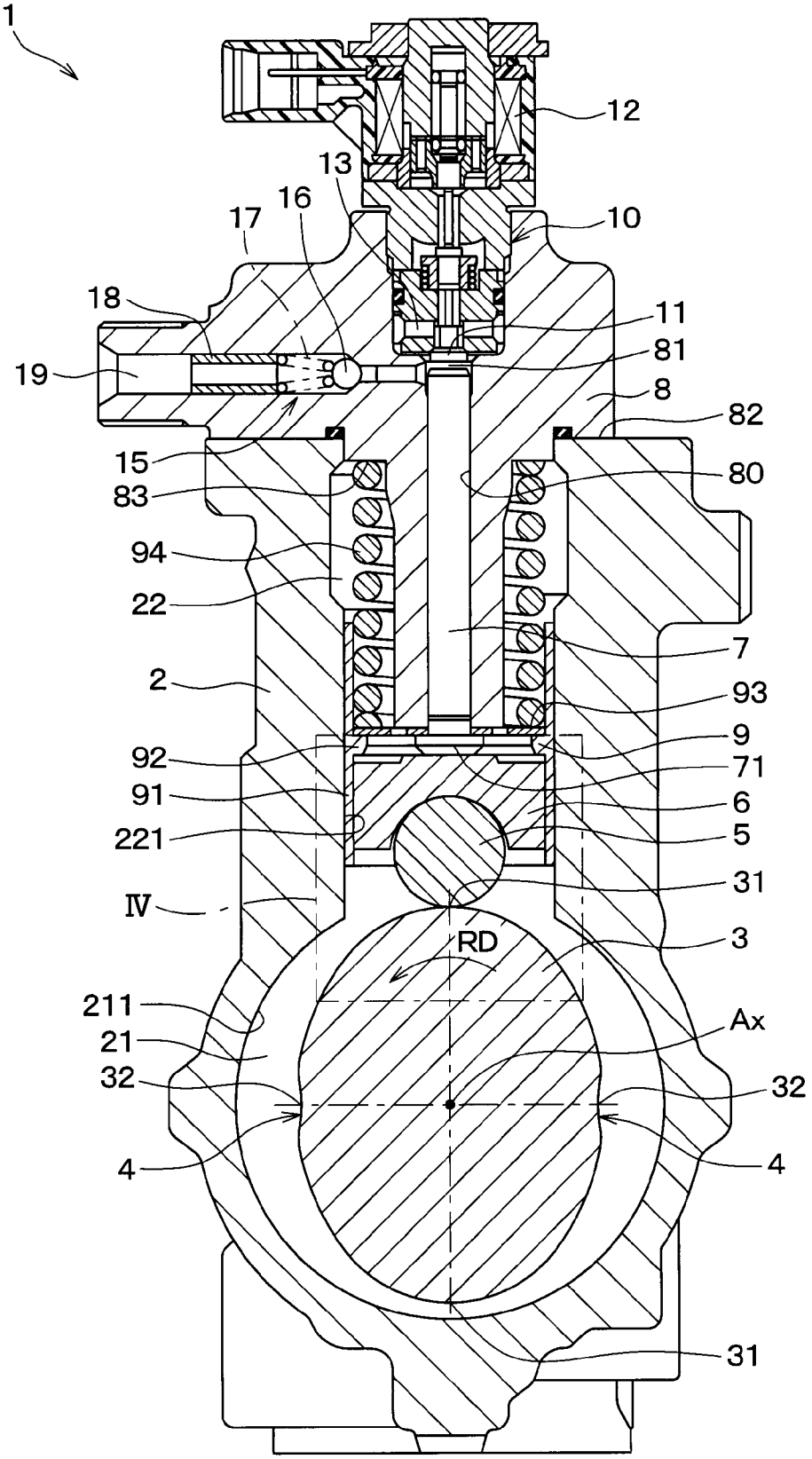
FIG. 1 is a sectional view showing a fuel injection pump according to a first embodiment.

Hereinafter, one example of the present disclosure will be described.

According to the one example, a fuel injection pump pressurizes fuel, and the fuel is injected and supplied to an internal combustion engine or the like. The fuel injection pump converts a rotating motion of a cam which is driven by the internal combustion engine or by an electric motor to a reciprocating motion of a plunger. The fuel injection pump further pressurizes the fuel in a pump chamber, located at a deep part of a cylinder that houses the plunger, and pressurizes and feeds the fuel. The fuel injection pump includes, for example, a roller and a shoe between the cam and the plunger. The roller is in contact with a surface of the cam and is enabled to rotate. The shoe holds the roller. The shoe includes an insert member which is placed on an axis line of the plunger and a base member which is placed outside of the insert member.

In an example, the shoe includes two components which are the base member and the insert member in the fuel injection pump. In addition, the fuel injection pump includes the base member which is a part of the shoe. To reduce friction between the roller and the shoe when the internal combustion engine starts, the base member is formed by a powder injection molded body which includes a solid lubricating material. That is, in the fuel injection pump, a number of the components of the shoe becomes large, and the shoe therefore has a complicated structure. Consequently, its manufacturing cost increases.

According to an exemplary embodiment of the present disclosure, friction between a roller and a shoe in a fuel injection pump is reduced with a simple structure and reliability of the fuel injection pump is enhanced The fuel injection pump is configured to pressurize and inject fuel. The fuel injection pump includes a cam, a housing, a roller, a shoe, a plunger, a cylinder, and a deformed section. The cam includes a cam ridge and is configured to rotate about a rotational axis of the cam. The housing includes a cam chamber which houses the cam and a sliding chamber communicated to the cam chamber. Lubricating oil is supplied to the housing. The roller is configured to rotate in contact with a surface of the cam. The shoe is in contact with and slides on a surface of the roller on a side opposite to the cam, and configured to reciprocate in the sliding chamber by a rotation of the cam. The plunger is configured to reciprocate with the shoe. The cylinder houses the plunger and includes a pump chamber to pressurize and feed the fuel by a reciprocation of the plunger. The deformed section is a groove or a protrusion which extends in a direction of a rotational axis of the cam, formed on a part of a surface of the cam, and has a shape different from a cam profile which contributes to a pressurizing and a feeding of the fuel.

According to the configuration, when the roller moves on the deformed section which is formed in the surface of the cam by the rotation of the cam, oil film is formed and held between the shoe and the roller by squeeze effect, and friction coefficient between the shoe and the roller is reduced. Therefore, a braking force, which is referred to as shoe braking torque hereinafter, by which the shoe brakes the rotation of the roller is smaller than a force, which is referred to as cam driving torque hereinafter, by which the cam drives to rotate the roller. Accordingly, the roller and the shoe are in a sliding state, and the cam and the roller are in a rolling state. Therefore, the fuel injection pump is enabled to protect the roller from seizure by a reduction of friction between the roller and the shoe with a simple structure and to have high reliability.

Embodiments of the present disclosure will be described below with reference to the drawings. The same reference numerals in the embodiments are given to the same or equivalent structures and explanation thereof are omitted.

First Embodiment

A first embodiment will be described with reference to the drawings. A fuel injection pump 1 in the present embodiment is configured to pressurize and feed fuel, such as light oil, which is injected and supplied to an internal combustion engine. The fuel is pressurized and fed from the fuel injection pump 1 and is accumulated in a common rail. Subsequently, the fuel is injected and supplied from multiple injectors which are connected to the common rail into cylinders in the internal combustion engine.

First, a structure of the fuel injection pump 1 will be described below. As shown in FIG. 1, the fuel injection pump 1 includes a housing 2, a cam 3, a deformed section 4 which is provided on the cam 3, a roller 5, a shoe 6, a plunger 7, a cylinder 8, or the like.

The housing 2 includes a cam chamber 21 and a sliding chamber 22. The cam chamber 21 has a substantially cylindrical shape and is defined by an inner wall 211. The cam 3 is housed in the cam chamber 21 and enabled to rotate. The sliding chamber 22 extends from the cam chamber 21 radially in one direction. The cam chamber 21 is communicated to the sliding chamber 22. Lubricating oil is supplied to the cam chamber 21 and the sliding chamber 22. The cam chamber 21 and the sliding chamber 22 are filled with the lubricating oil.

The cam 3 is housed in the cam chamber 21. The cam 3 receives torque transmitted from the unillustrated internal combustion engine or an unillustrated electric motor to an unillustrated cam shaft and is driven rotationally about a rotational axis of the cam 3. The cam 3 includes multiple cam ridges. The cam 3 in the first embodiment includes two cam ridges. In the drawings, a denotation Ax shows the rotational axis of the cam 3, and an arrow RD shows a rotating direction of the cam 3.

Figure 2:
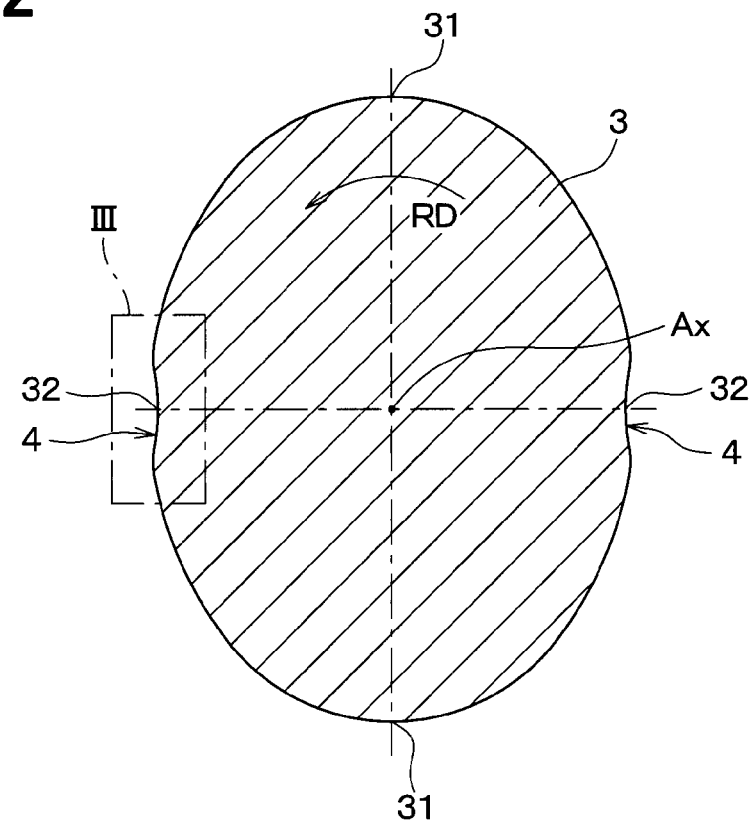
FIG. 2 is a view showing a profile of a cam according to a first embodiment.

FIG. 2 shows only the cam 3 equipped in the fuel injection pump 1 in the first embodiment. As shown in FIG. 2, the apexes of the two cam ridges are referred to as cam tops 31 hereinafter, respectively. Surfaces of the cam 3 at centers between the two cam tops 31 are referred to as cam bottoms 32 hereinafter, respectively. The cam ridge is also referred to as cam lobe, and the cam top 31 is also referred to as cam nose. The cam top 31 is a portion of a surface of the cam 3 at which the radius of the cam 3 is longest. The cam bottom 32 is a portion of the surface of the cam 3 at which the radius of the cam 3 is shortest. The cam 3 in the first embodiment includes two cam tops 31 at one side and at the other side in the radial direction, respectively. The two cam bottoms 32 are positioned in a direction orthogonal to a line connecting the two cam tops 31.

Figure 3:
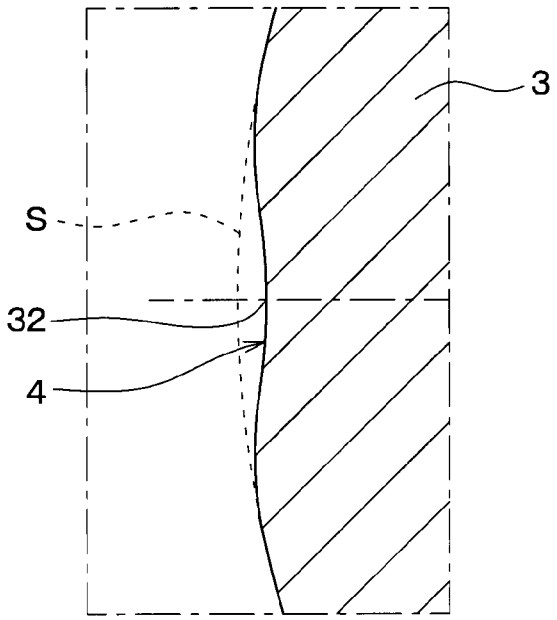
FIG. 3 is an enlarged view showing a part denoted by III in FIG. 2.

As shown in FIGS. 2 and 3, the deformed section 4 is formed in a part of the surface of the cam 3. A surface shape of the cam 3 is modified at the deformed section 4. The deformed section 4 in the first embodiment is formed at the cam bottom 32 in the surface of the cam 3. A broken line S in FIG. 3 shows a shape of the cam 3 in a configuration where the deformed section 4 is not formed on the surface of the cam 3. The deformed section 4 is a groove recessed toward the rotational axis of the cam 3 relative to the shape shown by the broken line S. The deformed section 4 extends in a direction of the rotational axis of the cam 3. Detail of the deformed section 4 will be described later.

Figure 4:
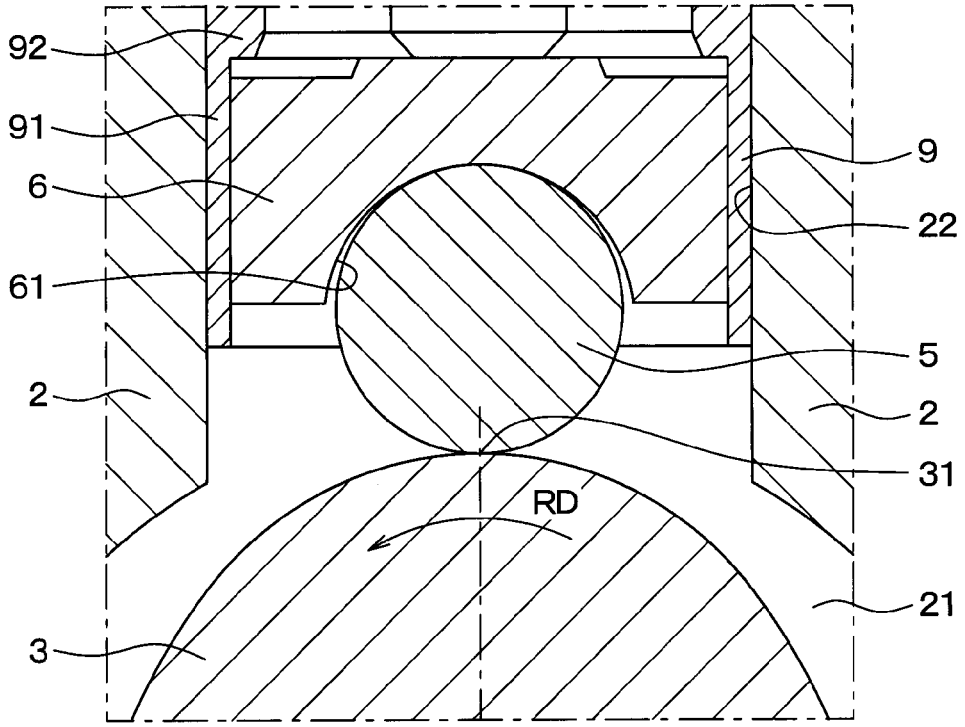
FIG. 4 is an enlarged view showing a part denoted by IV in FIG. 1.

As shown in FIGS. 1 and 4, the roller 5 is provided on the surface of the cam 3. The roller 5 has a columnar shape and is in contact to the surface of the cam 3. The roller 5 is enabled to rotate about the axis of the roller 5. The shoe 6 is provided on a side opposite to the cam 3 with respect to the roller 5. The shoe 6 includes a sliding contact surface 61 at a side closer to the roller 5. The sliding contact surface 61 has a circular arc shape. A curvature radius of the sliding contact surface 61 formed on the shoe 6 is equal to or slightly larger than a radius of the roller 5. The sliding contact surface 61 of the shoe 6 is in contact with and slides on the surface of the roller 5 on the side opposite to the cam 3. The shoe 6 is fit to the inside of a tappet 9.

The tappet 9 includes a hole portion 91 which is in contact with and slides on an inner wall 221 of the sliding chamber 22 and a protrusion 92 which protrudes from an inner wall of the hole portion 91 to an inner side of the sliding chamber 22. The tappet 9 is in contact with and slides on the inner wall 221 of the sliding chamber 22 and is configured to reciprocate along an axial direction of the sliding chamber 22. The shoe 6 is arranged inside of the hole portion 91 included in the tappet 9 and abuts against a surface of the protrusion 92 at a side closer to the cam 3. Therefore, the roller 5 and the shoe 6 reciprocate with the tappet 9 in the sliding chamber 22 along the axial direction of the sliding chamber 22 by the rotation of the cam 3.

As shown in FIG. 1, a spring seat 93 is placed on the protrusion 92 of the tappet 9 on the side opposite to the cam 3. An end portion 71 of the plunger 7 is attached to the spring seat 93. A cylinder chamber 80 located inside the cylinder 8 houses the plunger 7 such that the plunger 7 is movable back and forth.

The cylinder 8 houses the plunger 7 and is fixed to an end portion 82 which is a portion of the housing 2 and forms the sliding chamber 22. The cylinder 8 closes the sliding chamber 22 on a side opposite to the cam chamber 21. A surface 83 of the cylinder 8 closes the sliding chamber 22. A spring 94 is provided between the surface 83 and the spring seat 93. The spring 94 is a compression coil spring and biases the tappet 9, the shoe 6, and the roller 5 toward the cam 3 through the spring seat 93. Therefore, when the cam 3 rotates, the roller 5, the shoe 6, the tappet 9, the spring seat 93, and the plunger 7 reciprocates along the axial direction of the sliding chamber 22.

A pump chamber 81 is formed at a deep part of the cylinder chamber 80 which houses the plunger 7 in the cylinder 8. The pump chamber 81 is located in the cylinder chamber 80 on the side opposite to the cam 3. FIG. 1 shows a state where the cam tops 31 are positioned on an axis line of the plunger 7. In this state, a volume of the pump chamber 81 is smallest. When the cam rotates from the state shown in FIG. 1, the plunger 7 is moved toward the cam 3. When the cam bottoms 32 are positioned on the axis line of the plunger 7 as unillustrated, the volume of the pump camber 81 is largest. The position of the plunger 7 in the state where the volume of the pump chamber 81 is smallest is referred to as a top dead center hereinafter. On the other hand, the position of the plunger 7 in the state where the volume of the pump chamber 81 is largest is referred to as a bottom dead center hereinafter.

The fuel is supplied to the pump chamber 81 of the cylinder 8 through a metering valve unit 10 and is discharged from the pump chamber 81 of the cylinder 8 through a discharge valve unit 15. The metering valve unit 10 includes a metering valve 11 and an electromagnetic driving module 12. The metering valve 11 is an open/close valve and configured to communicate a fuel supply passage 13, through which the fuel is supplied from an unillustrated fuel inlet port, to the pump chamber 81 or block the fuel supply passage 13 from the pump chamber 81. The electromagnetic driving module 12 is configured to control a driving operation of the metering valve 11 by energization corresponding to a control implemented by an unillustrated electronic control device (ECU).

The discharge valve unit 15 includes a discharge valve 16, a discharge spring 17, a fixing member 18 and the like, and is provided in a discharge passage 19 which is configured to communicate to the pump chamber 81. The discharge valve 16 is a poppet valve and can be seated on or can be lifted from a valve seat arranged on an inner wall of the discharge passage 19. The discharge spring 17 biases the discharge valve 16 toward the valve seat. The fixing member 18 fixes the discharge spring 17 in the discharge passage 19.

An operation of the fuel injection pump 1 will be described below. The fuel injection pump 1 pressurizes and feeds the fuel through a process including a suction stroke, a metering stroke, a compression stroke, and a discharge stroke.

In the suction stroke, the plunger 7 moves from the top dead center toward the bottom dead center, and the volume of the pump chamber 81 is increased. Therefore, fuel pressure in the pump chamber 81 is reduced. At this point, the metering valve 11 is opened, and the fuel supply passage 13 is communicated to the pump chamber 81. Accordingly, the fuel is inhaled from the fuel supply passage 13 to the pump chamber 81.

In the metering stroke, the plunger 7 moves from the bottom dead center toward the top dead center. During this state, the metering valve 11 maintains its opened state. Therefore, the fuel returns from the pump chamber 81 to the fuel supply passage 13. In the metering stroke, the metering valve 11 controls an amount of the fuel which is discharged from the discharge passage 19 in the discharge stroke after the compression stroke. When the metering valve 11 is closed in the movement of the plunger 7 from the bottom dead center toward the top dead center, the communication between the fuel supply passage 46 and the pump chamber 81 is cut off. Accordingly, the metering stroke is finished, and the process is transferred to the compression stroke.

In the compression stroke, the plunger 7 further moves toward the top dead center subsequent to the metering stroke. The volume reduction of the pump chamber 81 raises the fuel pressure in the pump chamber 81 and causes compression of the fuel.

In the discharge stroke, when a force which is received by the discharge valve 16 from the fuel in the pump chamber 81 becomes larger than a sum of a force which is received by the discharge valve 16 from the fuel in a downstream of the discharge valve 16 and a biasing force of the discharge spring 17 during the compression stroke, the discharge valve 16 is lifted from the valve seat. Therefore, the fuel which has been compressed in the pump chamber 81 is discharged from the discharge passage 19.

Subsequently, when the plunger 7 starts moving from the top dead center toward the bottom dead center, the discharge valve 16 is closed, and the metering valve 11 is opened. Accordingly, the suction stroke is performed again. That is, the fuel injection pump 1 pressurizes and feeds the fuel by repeating the suction stroke, the metering stroke, the compression stroke, and the discharge stroke.

Effects of the deformed section 4 provided in the cam 3 of the fuel injection pump 1 will be described below. The operation of the fuel injection pump 1 starts in a state where a friction coefficient between the shoe 6 and the roller 5 is high without oil film between the shoe 6 and the roller 5, when the cam 3 starts rotating, for example, when the internal combustion engine starts or the electric motor starts. Due to this, the roller 5 may not rotate about the axis of the roller 5, and the cam 3 and the roller 5 may be in a sliding state in which the cam 3 and the roller 5 mutually slide on each other.

In addition, when the friction coefficient between the shoe 6 and the roller 5 is raised by, for example, a clogging with foreign object between the shoe 6 and the roller 5 while the fuel injection pump 1 is driven, the roller 5 may not rotate about the axis of the roller 5, and the cam 3 and the roller 5 may be in the sliding state. In this way, in a case where a peripheral speed of the cam 3 is raised while the cam 3 and the roller 5 are continued to be in the sliding state, the cam 3 and the roller 5 may be over limit of seizure and may be damaged.

In this state, a braking force, which is referred to as a shoe braking torque hereinafter, by which the shoe 6 brakes the rotation of the roller 5 is larger than a force, which is referred to as a cam driving torque hereinafter, by which the cam 3 drives rotation of the roller 5. Due to this, the cam 3 and the roller 5 are in the sliding state. That is, when the shoe braking torque is larger than the cam driving torque, the roller 5 does not rotate. The shoe braking torque may be reduced by a reduction in the friction coefficient between the shoe 6 and the roller 5. In general, the friction coefficient between the shoe 6 and the roller 5 may be reduced by a reduction in a surface roughness of the shoe 6. However, the method which reduces the surface roughness of the shoe 6 has a process limitation, and an advanced configuration is required to be more effective. In addition, the advanced method may not increase a manufacturing cost.

In the first embodiment, an efficient lubrication between the shoe 6 and the roller 5, that is, the formation of the oil film between the shoe 6 and the roller 5 decreases the friction coefficient between the shoe 6 and the roller 5. More specifically, the fuel injection pump 1 includes the deformed section 4 which is provided on a part of the surface of the cam 3. The surface shape of the cam 3 is modified at the deformed section 4. The deformed section 4 in the first embodiment is a groove formed on a part of the surface of the cam 3 and has a shape different from a cam profile which contributes to the pressurizing and feeding of the fuel by the fuel injection pump 1. The groove extends in the direction of the rotational axis of the cam 3. A depth of the groove of the deformed section 4 hardly affects the pressurizing and the feeding of the fuel by the fuel injection pump 1. In addition, the deformed section 4 in the first embodiment is placed at the cam bottom 32 in the surface of the cam 3. The cam 3 in the first embodiment includes the two cam ridges, and the cam bottoms 32 are formed at two positions on the surface of the cam 3 in the entirely of its perimeter. The deformed sections 4 are provided on the two cam bottoms 32, respectively.

Figure 5A:
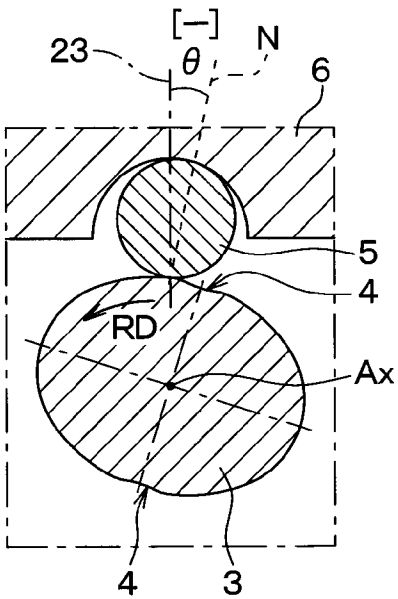
FIGS. 5A to 5D are explanatory views showing a behavior where a roller in a sliding state is transferred to be in a rolling state.
Figure 5B:
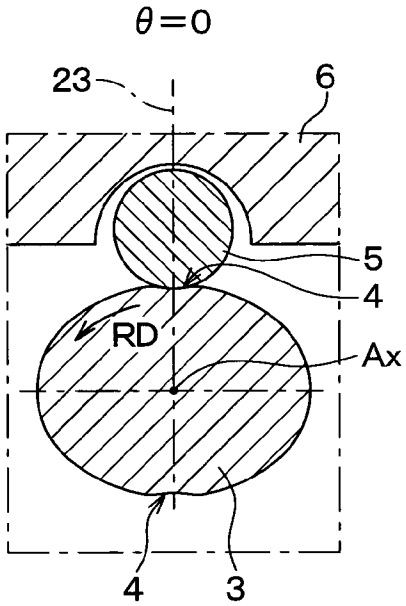
Figure 5C:
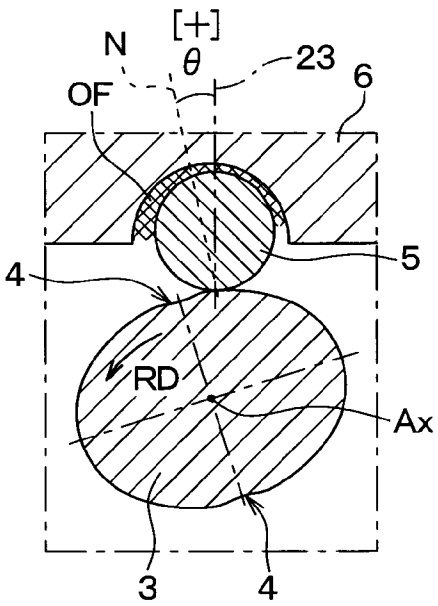

FIGS. 5A to 5D are explanatory views showing a state where the cam 3 and the roller 5 in the sliding state are transferred to be in a rolling state, in which the cam 3 and the roller 5 roll on each other. Chain lines with signs 23 in FIGS. 5A to 5C show the axis of the sliding chamber 22. Broken lines with signs N in FIGS. 5A and 5C show a common normal line between the cam 3 and the roller 5. Θ in FIGS. 5A to 5C shows an angle of the common normal line between the cam 3 and the roller 5 relative to the axis of the sliding chamber 22, that is, Θ shows a pressure angle. A state where the pressure angle θ resides on the forward side in the rotation direction of the cam 3 relative to the axis of the sliding chamber 22 is referred to as a state where the pressure angle θ is on the + side ((plus) side) hereinafter. On the other hand, a state where the angle θ is resides on the backward in the direction of the rotation direction of the cam 3 relative to the axis of the sliding chamber 22 is referred to as a state where the pressure angle θ is on the – side ((minus) side) hereinafter.

The cam 3 starts rotation at an arbitrary position when the internal combustion engine starts its operation, when the electric motor starts its operation, or the like. FIG. 5A shows a state immediately before a position at which the roller 5 is brought into contact with the cam 3 reaches the deformed section 4 after the cam 3 starts rotating. At this point, the friction coefficient between the shoe 6 and the roller 5 is high without the oil film between the shoe 6 and the roller 5. Therefore, the roller 5 does not rotate, and the roller 5 or the shoe 6 is not in the sliding state. The roller 5 and the cam 3 are in the sliding state. At this point, the pressure angle θ resides on the minus side.

FIG. 5B shows a state where the roller 5 is brought into contact with the cam 3 at the center of the deformed section 4 after the cam 3 slightly rotates from the state shown in FIG. 5A. At this point, the pressure angle θ is equal to 0°. Further, FIG. 5C shows a state where the roller 5 is brought into contact with the cam 3 at the backward in the direction of the rotation direction of the cam 3, after the cam 3 slightly rotates from the state where the roller 5 is in contact with the cam 3 at the center of the deformed section 4 as shown in FIG. 5B. At this point, the pressure angle θ is resides on the plus side.

Figure 5D:
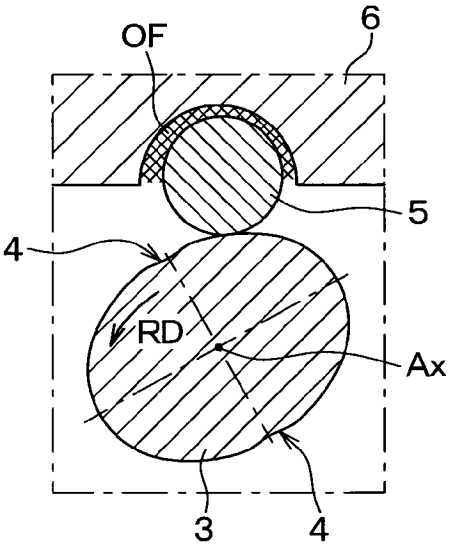

As shown in FIGS. 5A to 5C, when the position at which the roller 5 is in contact with the cam 3 moves in the deformed section 4, the pressure angle θ is changed greatly in a short time. Because of this, a center position of the roller 5 moves greatly in the short time. When a moving speed of the roller 5 is larger than a speed by which oil is discharged between the shoe 6 and the roller 5, the oil between the shoe 6 and the roller 5 is pressed, and pressure is caused in the oil by squeeze effect. Therefore, the oil film is formed and held between the shoe 6 and the roller 5. In FIGS. 5C and 5D, cross-hatched portions with a denotation OF show the oil film formed and held between the shoe 6 and the roller 5. When the oil film is formed and held between the shoe 6 and the roller 5 as described above, the friction coefficient between the shoe 6 and the roller 5 is reduced. Because of this, the shoe braking torque becomes smaller than the cam driving torque, and the roller 5 and the shoe 6 are in the sliding state, while the cam 3 and the roller 5 are in the rolling state.

Subsequently, the oil film is held between the shoe 6 and the roller 5 as shown in FIG. 5D. Therefore, the sliding state of the roller 5 and the shoe 6, and the rolling state of the cam 3 and the roller 5 are maintained. That is, the cam 3 and the roller 5 are protected from the seizure.

In the first embodiment, the deformed section 4 is formed at the cam bottom 32 in the surface of the cam 3. A change rate of the pressure angle θ when the roller 5 moves on the surface of the cam 3 is the highest at the cam bottom 32 in the cam profile which contributes to the pressurizing and feeding of the fuel. Therefore, the deformed section 4 placed at the cam bottom 32 enables the change rate of the pressure angle θ to become higher. That is, by increasing the moving speed of the center position of the roller 5 when the roller 5 moves on the deformed section 4 formed in the surface of the cam 3, the oil film between the shoe 6 and the roller 5 is steadily formed and held, thereby to enable the cam 3 and the roller 5 to be in rolling state steadily.

Figure 6:
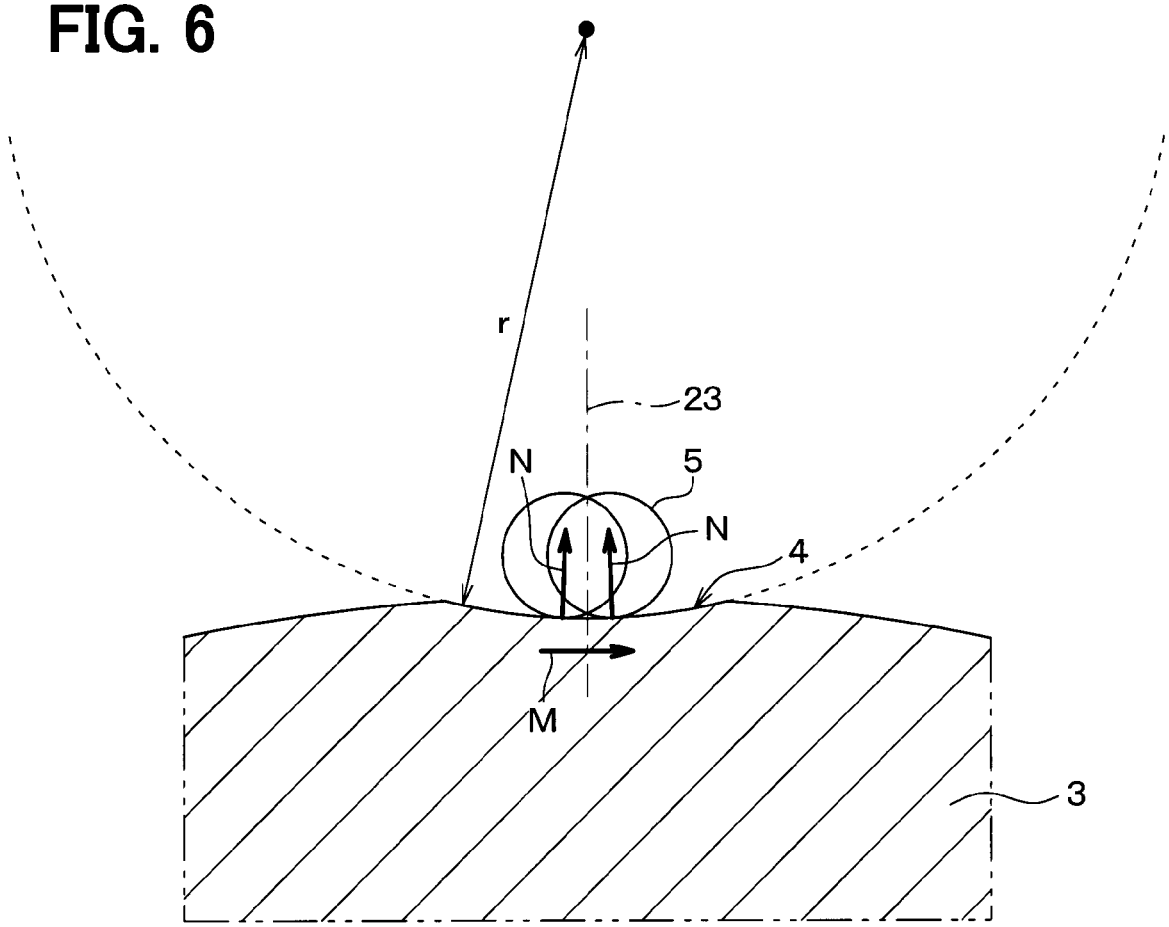
FIG. 6 is an explanatory view showing a curvature radius of a deformed section.
Figure 7:
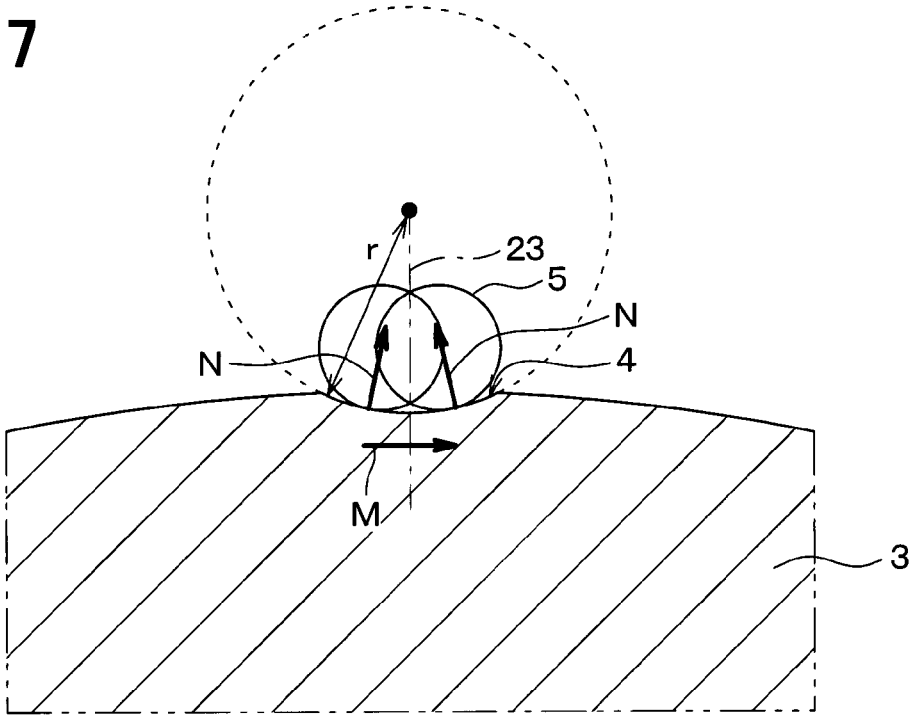
FIG. 7 is an explanatory view showing a curvature radius of the deformed section.

A curvature radius r of the deformed section 4 will be described below with reference to FIGS. 6 and 7. FIG. 6 shows an example in a case where the curvature radius r of the deformed section 4 is relatively large. On the other hand, FIG. 7 shows an example in a case where the curvature radius r of the deformed section 4 is relatively small. FIGS. 6 and 7 show a state where the roller 5 passes on the deformed section 4. An arrow M in FIGS. 6 and 7 shows a direction in which the roller 5 on the deformed section 4 moves when the roller 5 moves on the deformed section 4 provided on the cam 3 in a case where the cam 3 rotates.

When the curvature radius r of the deformed section 4 is relatively large as shown in FIG. 6, the change rate of the pressure angle θ on the roller 5 which moves on the deformed section 4 is smaller in comparison with a case shown in FIG. 7. That is, the squeeze effect obtained by the deformed section 4 is small. On the other hand, when the curvature radius r of the deformed section 4 is relatively small as shown in FIG. 7, the change rate of the pressure angle θ on the roller 5 which moves on the deformed section 4 is larger in comparison with the case shown in FIG. 6. That is, the squeeze effect obtained by the deformed section 4 is large. Therefore, the curvature radius r of the deformed section 4 is may be approximated to a radius R of the roller 5, in a manufacturable range. More specifically, a relationship between the curvature radius r of the deformed section 4 and the radius R of the roller 5 may be set in a range of $R<r<R\times30$. The relationship between the curvature radius r of the deformed section 4 and the radius R of the roller 5 may be, more specifically, set in a range of $R<r<R\times10$. In other words, the squeeze effect obtained by the deformed section 4 becomes larger as the curvature radius r of the deformed section 4 is closer to the radius R of the roller 5. That is, the formation and the holding of the oil film between the shoe 6 and the roller 5 by the squeeze effect enables the cam 3 and the roller 5 to be in the rolling state steadily.

The fuel injection pump 1 in the first embodiment described above produces effects described below.

(1) The fuel injection pump 1 in the first embodiment includes the deformed section 4 which is provided on a part of the surface of the cam 3 and has the shape different from the cam profile which contributes to the pressurizing and feeding of the fuel. The deformed section 4 is a groove which extends in the direction of the rotational axis of the cam 3. According to the configuration, when the roller 5 moves on the deformed section 4 which is formed in the surface of the cam 3 by the rotation of the cam 3, the oil film is formed and held between the shoe 6 and the roller 5 by the squeeze effect, and the friction coefficient between the shoe 6 and the roller 5 is reduced. Therefore, the shoe braking torque becomes smaller than the cam driving torque. That is, the roller 5 and the shoe 6 are in the sliding state, and the cam 3 and the roller 5 are in the rolling state. Therefore, the injection pump 1 is enabled to protect the cam 3 and the roller 5 from causing the seizure and to improve a reliability.

(2) In the deformed section 4 in the first embodiment, the change rate of the pressure angle θ in the state where the roller 5 moves on the deformed section 4 formed in the surface of the cam 3 is larger than the change rate of the pressure angle θ in the state where the roller 5 moves on a part of the surface of the cam 3 except for the deformed section 4. Therefore, the moving speed of the center position of the roller 5 which moves on the deformed section 4 formed in the surface of the cam 3 is larger than the moving speed of the center position of the roller 5 which moves on the part of the surface in the cam 3 except for the deformed section 4. The oil between the shoe 6 and the roller 5 is pressed, and the pressure is generated on the oil by the squeeze effect. Therefore, the oil film is formed between the shoe 6 and the roller 5 and held.

(3) The deformed section 4 is placed at the cam bottom 32 in the first embodiment. Therefore, the change rate of the pressure angle θ at the cam bottom 32 when the roller 5 moves on the surface of the cam 3 is largest in the cam profile. That is, the deformed section 4 provided on the cam bottom 32 enables the change rate of the pressure angle θ to become larger. The formation and the holding of the oil film between the shoe 6 and the roller 5 are implemented steadily by the increasing in the moving speed of the center position of the roller 5 which moves on the deformed section 4 formed in the surface of the cam 3, and the cam 3 and the roller 5 are enabled to be in the rolling state steadily (4) In the first embodiment, the deformed sections 4 are provided at the respective two cam bottoms 32. That is, the rolling state of the cam 3 and the roller 5 at an early state after the cam 3 starts rotating, such as when the internal combustion engine starts or when the electric motor starts, enables the cam 3 and the roller 5 to be protected from seizure.

(5) In the first embodiment, the relationship between the curvature radius r of the deformed section 4 and the radius R of the roller 5 is set in the range of $R<r<R\times30$. That is, the change rate of the pressure angle θ when the roller 5 moves on the deformed section 4 is enabled to become larger by the reduction in the curvature radius r of the deformed section 4 in a manufacturable range. Therefore, the cam 3 and the roller 5 are enabled to roll steadily by the increasing of the moving speed of the center position of the roller 5 which moves on the deformed section 4, and by the formation and the holding of the oil film between the shoe 6 and the roller 5 with the squeeze effect.

(6) In the first embodiment, the deformed sections 4 are provided on the respective two cam bottoms 32 in the surface of the cam 3. That is, the roller 5 moves on the deformed section 4 formed in the surface of the cam 3, during the plunger 7 reciprocates in the cylinder 8 one time when the cam 3 starts rotating, for example, when the internal combustion engine starts or the electric motor starts. Therefore, the rolling state of the cam 3 and the roller 5 at an early state after the starting of the rotation of the cam 3 enables the cam 3 and the roller 5 to be protected from the seizure.

Second Embodiment to Fourth Embodiment

Figure 8:
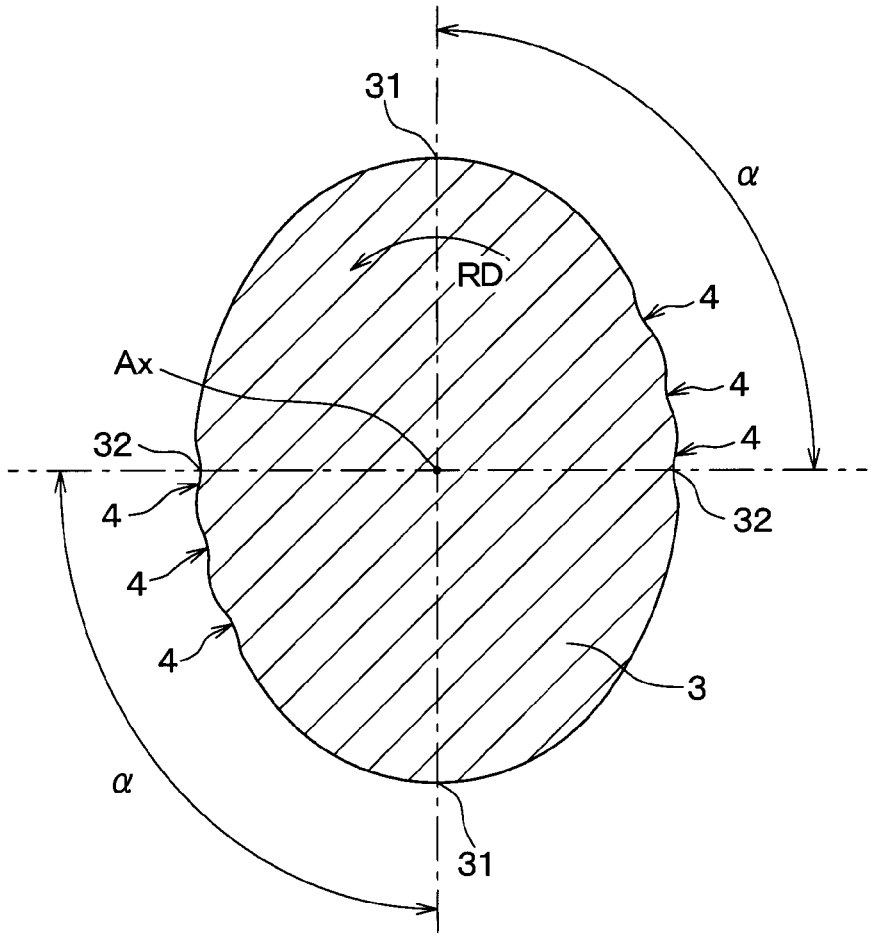
FIG. 8 is a view showing a profile of a cam according to a second embodiment.
Figure 9:
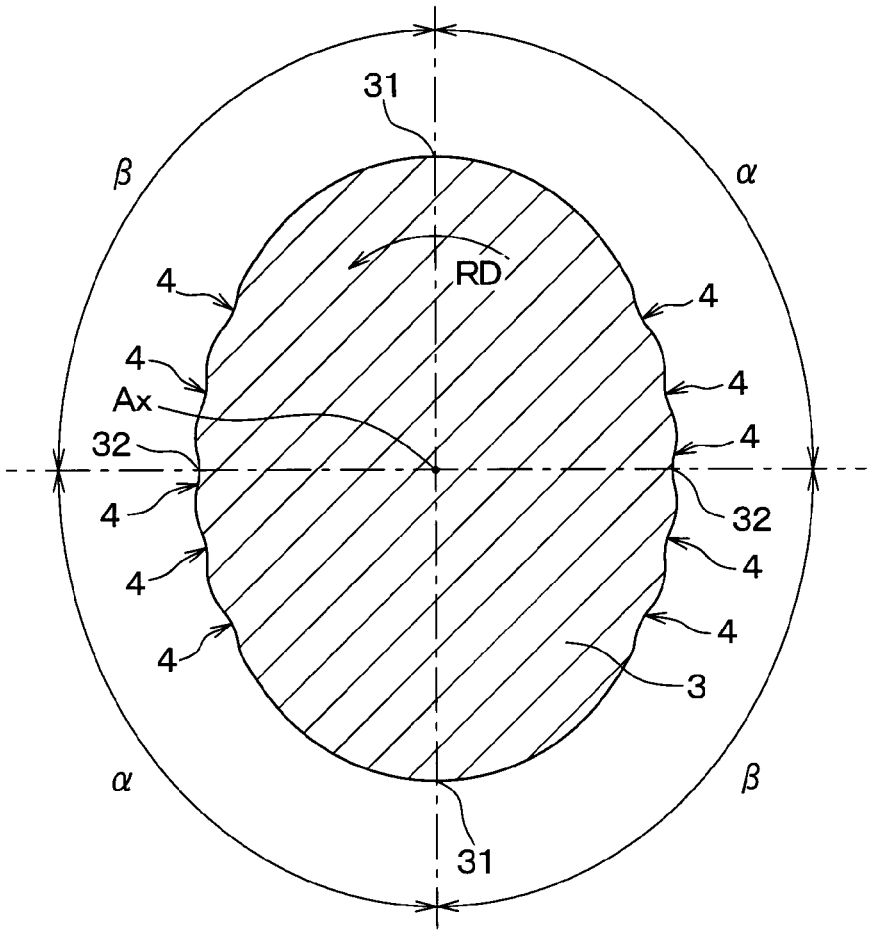
FIG. 9 is a view showing a profile of a cam according to a third embodiment.
Figure 10:
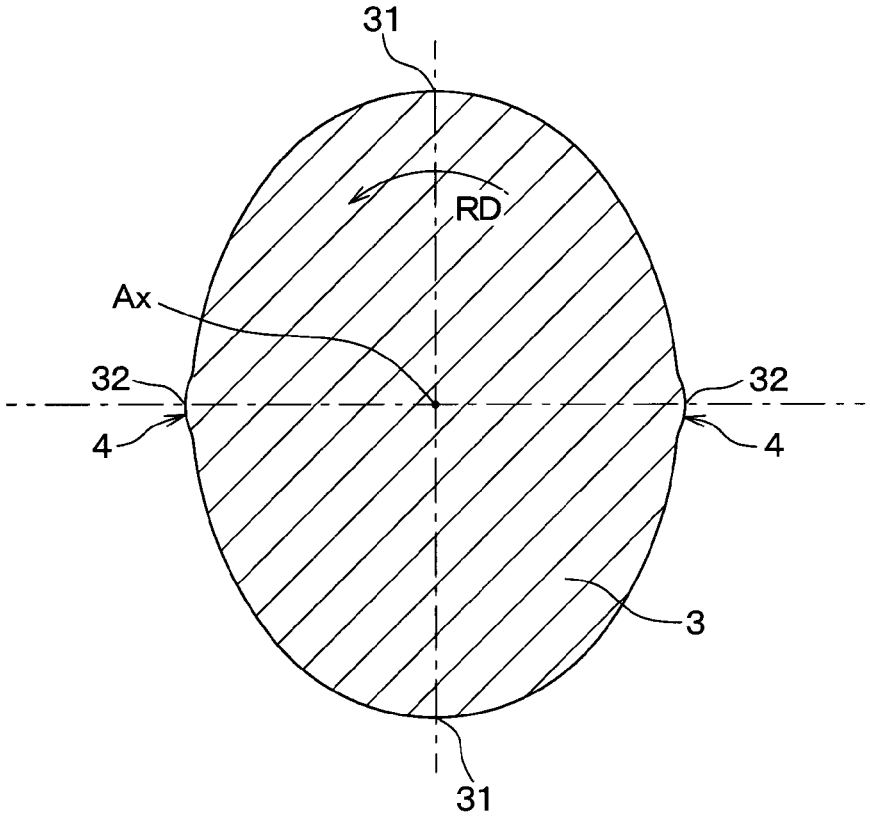
FIG. 10 is a view showing a profile of a cam according to a fourth embodiment.

The fuel injection pumps 1 according to a second embodiment to a fourth embodiment are different from that according to the first embodiment only in configurations of the deformed section 4. Only a configuration which is different from that in the first embodiment will be described below. The cam 3 equipped in the fuel injection pump 1 in the second embodiment to the fourth embodiment includes the two cam ridges, similarly to the first embodiment. FIGS. 8 to 10 will be referred in the second embodiment to the fourth embodiment and shows only the cam 3 equipped in the fuel injection pump 1.

Second Embodiment

The second embodiment will be described below with reference to FIG. 8. As described in the first embodiment, the fuel injection pump 1 pressurizes and feeds the fuel through the process including the suction stroke, the metering stroke, the compression stroke, and the discharge stroke. In the suction stroke, the plunger 7 moves from the top dead center toward the bottom dead center. Therefore, the roller 5 is in contact with the surface of the cam 3 in the suction stroke in an area from a predetermined cam top 31 to the cam bottom 32 placed backward in the direction of the rotation direction of the cam 3. The area in which the roller 5 is in contact with the surface of the cam 3 in the suction stroke is referred to as "an area which contributes to the suction stroke in the cam surface" hereinafter. A two-way arrow a in FIG. 8 shows the area which contributes to the suction stroke in the cam surface.

The deformed sections 4 in the second embodiment are formed in the area which contributes to the suction stroke in the cam surface. The three deformed sections 4 are continually formed in the circumferential direction in the area which contributes to the suction stroke in the cam surface in the second embodiment. The deformed section 4 in the second embodiment is a groove recessed toward the rotational axis of the cam 3. The groove extends in the direction of the rotational axis of the cam 3.

The cam 3 in the second embodiment includes the two cam ridges, and the areas which contributes to the suction stroke in the cam surface are formed at two positions on the surface of the cam 3 in the entirely of its perimeter. The areas which contribute to the suction stroke in the cam surface at two position each include three deformed sections 4. That is, the deformed sections 4 are provided on the two cam ridges, respectively.

Effects of the fuel injection pump 1 in the second embodiment described above will be described below. The fuel pressure in the pump chamber 81 is raised in the compression stroke and the discharge stroke, during the pressurizing and the feeding of the fuel by the fuel injection pump 1. A force received by the plunger 7 from the fuel pressure in the pump chamber 81 is transmitted to the roller 5 through the plunger 7 and the shoe 6. Accordingly, pressure applied to a position at which the roller 5 is in contacted with the cam 3 is raised. On the other hand, the fuel pressure in the pump chamber 81 becomes negative in the suction stroke, during the pressurizing and the feeding of the fuel by the fuel injection pump. Therefore, the pressure applied to the position at which the roller 5 is in contact with the cam 3 is smaller than a pressure applied during the compression stroke and the discharge stroke. That is, a load which is applied to the deformed section 4 and the roller 5 when the roller 5 moves on the deformed section 4 is reduced, and the roller 5 is protected from the seizure, by the deformed section 4 formed in the area which contributes to the suction stroke in the cam surface, in the second embodiment.

The multiple cam ridges include the deformed sections 4, respectively, in the second embodiment. That is, the roller 5 moves on the deformed section 4 formed in the surface of the cam 3, during the plunger 7 reciprocates in the cylinder 8 one time when the cam 3 starts rotating in the state where, for example, the internal combustion engine starts or where the electric motor starts. Therefore, the rolling state of the cam 3 and the roller 5 at an early state after the starting of the rotation of the cam 3 enables the cam 3 and the roller 5 to be protected from the seizure.

Third Embodiment

A third embodiment will be described below with reference to FIG. 9. As described in the first embodiment, the plunger 7 moves from the bottom dead center toward the top dead center during the metering stroke, the compression stroke and the discharge stroke, in the pressurizing and feeding of the fuel by the fuel injection pump 1. Therefore, the roller 5 is in contact with the surface of the cam 3 in the metering stroke, the compression stroke, and the discharge stroke within an area between a specific cam bottom 32 and the cam top 31 placed at the frontward toward the circulation of the cam 3. The area in which the roller 5 is in contact with the surface of the cam 3 in the metering stroke, the compression stroke, and the discharge stroke is referred to as "an area which contributes to the metering stroke to the discharge stroke in the cam surface" hereinafter. Two-way arrows β in FIG. 9 each shows the area which contributes to the metering stroke to the discharge stroke in the cam surface. The two-way arrows α in FIG. 9 each shows the area which contributes to the suction stroke in the cam surface, similarly to the two-way arrow a in FIG. 8.

The deformed sections 4 in the third embodiment are formed in the area which contributes to the suction stroke in the cam surface and in the area which contributes to the metering stroke to the discharge strokes in the cam surface. In the third embodiment, the five deformed sections 4 are continually formed in the circumferential direction from the area which contributes to the suction stroke in the cam surface to the area which contributes to the metering stroke to the discharge stroke in the cam surface. The deformed section 4 in the third embodiment is a groove recessed toward the rotational axis of the cam 3. The groove extends in the direction of the rotational axis of the cam 3.

The cam 3 in the third embodiment includes the two cam ridges, and the areas which contribute to the suction stroke in the cam surface are formed at two positions on the surface of the cam 3 in the entirely of its perimeter. In addition, the area which contributes to the metering stroke to the discharge stroke in the cam surface is also formed at two positions on the surface of the cam 3 in the entirely of its perimeter. The deformed sections 4 are provided on the area which contributes to the suction stroke in the cam surface and the area which contributes to the metering stroke to the discharge stroke in the cam surface. That is, the deformed sections 4 are provided on the two cam ridges, respectively.

In the fuel injection pump 1 in the third embodiment described above, the rolling state of the cam 3 and the roller 5 at an early state after the cam 3 starts rotating, such as when the internal combustion engine starts or the electric motor starts, enables the cam 3 and the roller 5 to be protected from the seizure.

Fourth Embodiment

The fourth embodiment will be described below with reference to FIG. 10. The deformed section 4 in the fourth embodiment is a protrusion formed on a part of the surface of the cam 3 and has a shape different from the cam profile which contributes to the pressurizing and feeding of the fuel by the fuel injection pump 1. The protrusion protrudes outward in the radial direction of the cam 3 and extends in the direction of the rotational axis of the cam 3. A height of the protrusion is set to hardly affect the pressurizing and the feeding of the fuel by the fuel injection pump 1.

The deformed section 4 in the fourth embodiment is formed in the cam bottom 32 in the surface of the cam 3. The cam 3 in the fourth embodiment includes the two cam ridges, and the cam bottoms 32 are therefore formed at two positions on the surface of the cam 3 in the entirely of its perimeter. The deformed sections 4 are provided on the two cam bottoms 32, respectively. The structure in the fourth embodiment described below also produces operational effects same as the first embodiment or the like. In addition, the structure in which the deformed section 4 is the protrusion according to the fourth embodiment may be also applied to the second embodiment, the third embodiment, a fifth embodiment or a sixth embodiment which will be described below.

Fifth Embodiment and Sixth Embodiment

Figure 11:
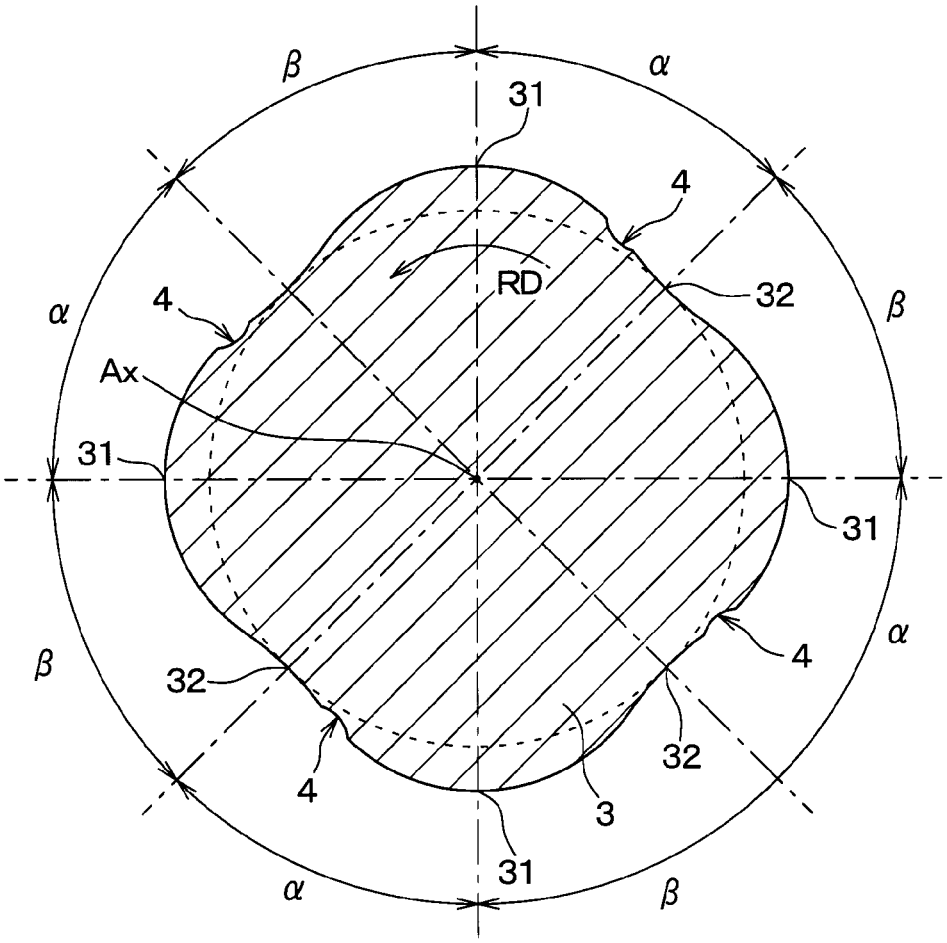
FIG. 11 is a view showing a profile of a cam according to a fifth embodiment.
Figure 12:
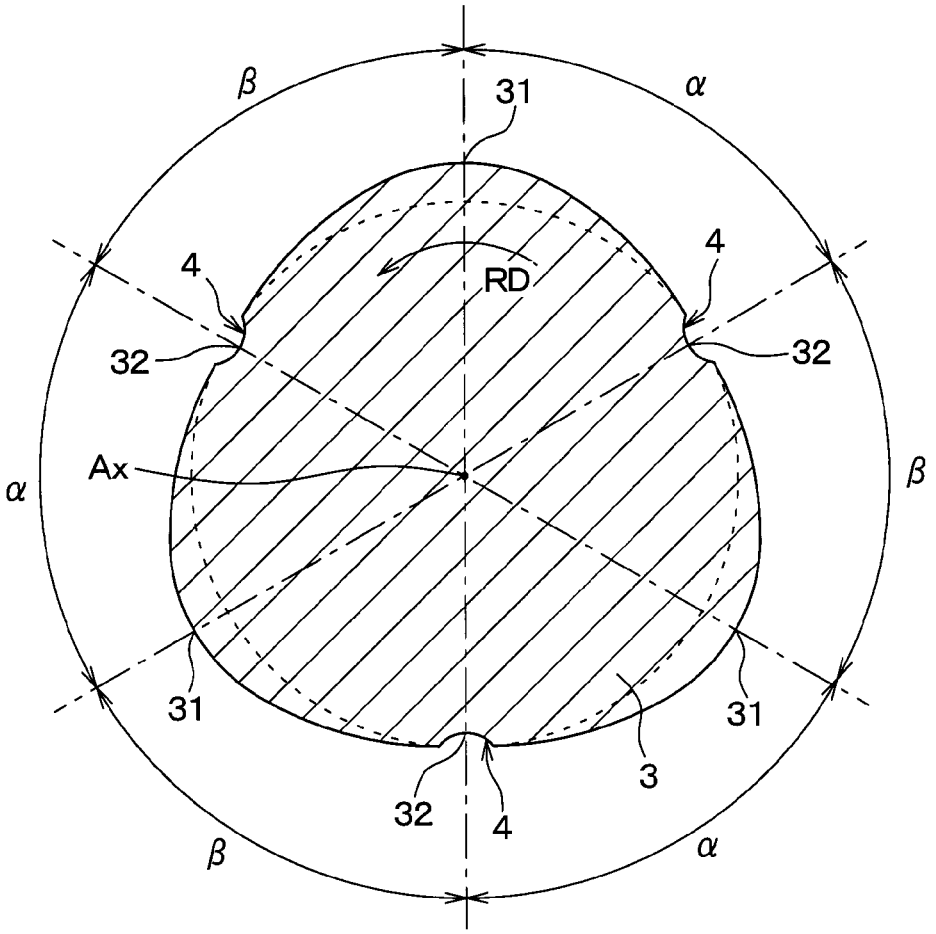
FIG. 12 is a view showing a profile of a cam according to a sixth embodiment.

The fuel injection pumps 1 according to the fifth embodiment and the sixth embodiment are different from that according to the first embodiment or the like only in configurations of the cam 3, and others are similar to the first embodiment. Therefore, configurations which are different from that in the first embodiment or the like will be described below. FIG. 11 according to the fifth embodiment and FIG. 12 according to the sixth embodiment show only the cam 3 equipped in the fuel injection pump 1.

Fifth Embodiment

As shown in FIG. 11, the cam 3 equipped in the fuel injection pump 1 in the fifth embodiment includes four cam ridges. The deformed section 4 in the fifth embodiment is a groove recessed toward the rotational axis of the cam 3. The groove extends in the direction of the rotational axis of the cam 3.

The cam 3 in the fifth embodiment includes the four cam ridges, and the areas which contributes to the suction stroke in the cam surface are formed at four positions on the surface of the cam 3 in the entirely of its perimeter. The areas which contribute to the suction stroke in the cam surface at the four positions each includes one deformed section 4. That is, the deformed sections 4 are formed in the multiple cam ridges, respectively. The deformed section 4 may be placed on an arbitrary position on the surface of the cam and is not limited to be placed at the position shown in FIG. 11.

Sixth Embodiment

The cam 3 equipped in the fuel injection pump 1 in the sixth embodiment includes three cam ridges. The deformed section 4 in the sixth embodiment is a groove recessed toward the rotational axis of the cam 3. The groove extends in the direction of the rotational axis of the cam 3.

The cam 3 in the sixth embodiment includes three cam ridges, and the cam bottoms 32 are formed at three positions on the surface of the cam 3 in the entirely of its perimeter. The cam bottoms 32 at the three positions each include ones deformed section 4. The deformed section 4 may be placed at an arbitrary position on the surface of the cam and is not limited to be placed at the position shown in FIG. 12.

Other Embodiment

The present disclosure is not limited to the above embodiments and/or modifications but can be further modified in various manners without departing from a spirit of the present disclosure. Each embodiment in the present disclosure is not unrelated each other and may be combined suitably except for a case where combinations are clearly impossible. Elements provided to the embodiment in the each embodiment is not necessarily essential except for a case where the elements are specified as a particularly essential element, or a case where the elements are clearly essential in principle. In addition, the present disclosure is not limited to a specific number even in a case where a number such as an amount, a value, a quantity, a scope is mentioned in the each embodiment, except when the number is specified as a particularly essential number, or when the number is clearly limited to the specific number in principal. In addition, the present disclosure is not limited to a specific shape, a specific positional relation or the like even in a case where a specific shape, a specific positional relation or the like is mentioned in the each embodiment, except when the specific shape, the specific positional relation or the like is especially specified, or when the specific shape, the specific positional relation or the like is clearly limited in principal.

(1) The fuel injection pump 1 is described so as to pressurize and feed the fuel, such as the light oil, which is injected and supplied to the internal combustion engine in the each embodiment. However, the present disclosure is not limited to the above. The fuel injection pump 1 may pressurize and feed fuel injected to, for example, an exhaust pipe or an intake pipe. Further, the fuel injection pump 1 may pressurize and feed fuel injected to a gasoline engine or fuel injected to a fuel battery.

(2) The cam 3 equipped in the fuel injection pump 1 includes the multiple cam ridges in the each embodiment. However, the present disclosure is not limited to the above. The cam 3 equipped in the fuel injection pump 1 may include one cam ridge.

(3) The deformed section 4 is formed in the surface of the cam 3 at the cam bottom 32, at the area which contributes to the suction stroke in the cam surface, or at the area which contributes to the metering stroke to the discharge stroke. However, the present disclosure is not limited to the above. The deformed section 4 may be formed at, for example, the cam top 31 or a base circle in the surface of the cam 3.

What is claimed is:

1. A fuel injection pump to pressurize and inject fuel, the fuel injection pump comprising:

a cam configured to rotate about a rotational axis of the cam and that includes a cam ridge;

a housing configured to be supplied with lubricating oil and that includes a cam chamber that houses the cam and a sliding chamber communicated to the cam chamber;

a roller configured to be in contact with and rotate on a surface of the cam;

a shoe that is configured to be in contact with and slide on a surface of the roller on a side opposite to the cam and configured to reciprocate in the sliding chamber by rotation of the cam;

a plunger configured to reciprocate with the shoe;

a cylinder that houses the plunger and includes a pump chamber to pressurize and feed the fuel by reciprocation of the plunger; and a deformed section that is a groove or a protrusion formed on a part of the surface of the cam and extending in a direction of the rotational axis of the cam, the deformed section having a shape different from a cam profile of the cam which contributes to pressurizing and feeding of the fuel, wherein the deformed section includes a plurality of deformed sections formed in an area of the surface of the cam, the area contributing to a suction stroke.

2. The fuel injection pump according to claim 1, wherein a pressure angle θ is an angle of a common normal line between the cam and the roller relative to an axis of the sliding chamber, and the groove or the protrusion which is the deformed section is formed such that, when the cam rotates, a change rate of the pressure angle in a state where the roller moves on the deformed section provided on the surface of the cam is larger than a change rate of the pressure angle in a state where the roller moves on a part of the surface of the cam except for the deformed section.

3. The fuel injection pump according to claim 1, wherein the cam includes a plurality of cam ridges including the cam ridge, and the deformed section is formed on each of the cam ridges.

4. The fuel injection pump according to claim 1, wherein the cam includes two cam tops, each of which is an apex of the cam ridge, at one side and at another side in the radial direction, respectively, and the deformed section is formed on a cam bottom which is the surface of the cam at a center between the two cam tops.

5. The fuel injection pump according to claim 1, wherein a process of the pressurizing and the feeding of the fuel includes the suction stroke, a metering stroke, a compression stroke, and a discharge stroke, the plunger is configured to increase a volume of the pump chamber and to cause the pump chamber to inhale fuel in the suction stroke, the plunger is configured to decrease a volume of the pump chamber with metering of the fuel in the metering stroke and is configured to pressurize and discharge the fuel, and the deformed section is formed on the surface of the cam in an area in which the roller is in contact with the surface of the cam in the suction stroke.

6. The fuel injection pump according to claim 5, wherein the deformed section is located on the surface of the cam in the area in which the roller is in contact with the surface of the cam in the suction stroke, and in an area in which the roller is in contact with the surface of the cam in the metering stroke, the compression stroke, and the discharge stroke.

7. The fuel injection pump according to claim 1, wherein the deformed section is the groove which extends in the direction of the rotational axis of the cam in a part of the surface of the cam, and a relationship between a curvature radius r of the deformed portion and a radius R of the roller is set in a range of $R<r<R\times30$.

8. The fuel injection pump according to claim 1, wherein the deformed sections includes three deformed sections in each area of the surface of the cam, the area contributing to the suction stroke.

9. The fuel injection pump according to claim 8, wherein the area includes two areas.

10. The fuel injection pump according to claim 1, wherein a curvature radius of a sliding contact surface of the shoe is larger than a radius of the roller.

11. The fuel injection pump according to claim 1, wherein the shoe is configured:

to be in contact with the surface of the roller without oil film therebetween, and to be separate from the surface of the roller to form oil film therebetween.

12. A fuel injection pump to pressurize and inject fuel, the fuel injection pump comprising:

a cam configured to rotate about a rotational axis of the cam and that includes a cam ridge;

a housing configured to be supplied with lubricating oil and that includes a cam chamber that houses the cam and a sliding chamber communicated to the cam chamber;

a roller configured to be in contact with and rotate on a surface of the cam;

a shoe that is configured to reciprocate in the sliding chamber by rotation of the cam, the shoe configured:

to be in contact with and slide on a surface of the roller on a side opposite to the cam, and to be separate from the surface of the roller;

a plunger configured to reciprocate with the shoe;

a cylinder that houses the plunger and includes a pump chamber to pressurize and feed the fuel by reciprocation of the plunger; and a deformed section that is a groove or a protrusion formed on a part of the surface of the cam and extending in a direction of a rotational axis of the cam, the deformed section having a shape different from a cam profile of the cam which contributes to pressurizing and feeding of the fuel, wherein the deformed section includes a plurality of deformed sections formed in an area of the surface of the cam, the area contributing to a suction stroke.

13. The fuel injection pump according to claim 12, wherein the shoe is configured:

to be in contact with the surface of the roller without oil film therebetween; and to be separate from the surface of the roller to form oil film therebetween.

* * * * *